US007489320B2

(12) United States Patent
Rai et al.

(10) Patent No.: US 7,489,320 B2
(45) Date of Patent: Feb. 10, 2009

(54) SYSTEM AND METHOD FOR CONSERVING MEMORY BANDWIDTH WHILE SUPPORTING MULTIPLE SPRITES

(75) Inventors: Barinder Singh Rai, Surrey (CA); Jimmy Kwok Lap Lai, Vancouver (CA)

(73) Assignee: Seiko Epson Corporation, Tokyo (JP)

( * ) Notice: Subject to any disclaimer, the term of this patent is extended or adjusted under 35 U.S.C. 154(b) by 608 days.

(21) Appl. No.: 11/128,554

(22) Filed: May 13, 2005

(65) Prior Publication Data

US 2006/0256128 A1 Nov. 16, 2006

(51) Int. Cl.
*G09G 5/02* (2006.01)

(52) U.S. Cl. ..... 345/589; 345/590; 345/591; 345/592; 345/537; 345/538; 345/549

(58) Field of Classification Search ..... None
See application file for complete search history.

(56) References Cited

U.S. PATENT DOCUMENTS 5,546,518 A 8/1996 Blossom et al.
5,638,501 A 6/1997 Gough et al.
5,748,174 A * 5/1998 Wong et al. ..... 715/798
5,835,103 A * 11/1998 Butler et al. ..... 345/531
5,892,521 A 4/1999 Blossom et al.
6,262,746 B1 7/2001 Collins
6,697,108 B1 * 2/2004 Chen et al. ..... 348/241
2001/0035862 A1 * 11/2001 Nakamura et al. ..... 345/204
2002/0052235 A1 5/2002 Hirsch et al.

* cited by examiner

*Primary Examiner*—Kee M Tung
*Assistant Examiner*—Jwalant Amin
(74) *Attorney, Agent, or Firm*—Mark P. Watson

(57) ABSTRACT

A system and method for conserving memory bandwidth while supporting multiple sprites includes a memory device that stores main display data and the multiple sprites for presentation upon a display device. A display controller populates a fetch table with pixel source identifiers that indicate pixel sources from either the main display data or one of the multiple sprites. The pixel source identifiers correspond to display pixels of the display device. The display controller then utilizes the pixel source identifiers to directly locate the appropriate display pixels from the various pixel sources for providing to the display device.

15 Claims, 8 Drawing Sheets

128

134

| | | | | | | |
|---|---|---|---|---|---|---|
| 0 | 0 | 0 | 0 | 1 | 0 | 0 |
| 0 | 0 | 0 | 2 | 1 | 2 | 0 |
| 0 | 0 | 0 | 2 | 2 | 2 | 3 |
| 0 | 0 | 4 | 5 | 2 | 2 | 0 |
| 0 | 0 | 0 | 5 | 0 | 0 | 0 |

440

SYSTEM AND METHOD FOR CONSERVING MEMORY BANDWIDTH WHILE SUPPORTING MULTIPLE SPRITES

BACKGROUND SECTION

1. Field of Invention

This invention relates generally to electronic display controller systems, and relates more particularly to a system and method for conserving memory bandwidth while supporting multiple sprites.

2. Description of the Background Art

Implementing efficient methods for displaying electronic image data is a significant consideration for designers and manufacturers of contemporary electronic devices. However, efficiently displaying image data with electronic devices may create substantial challenges for system designers. For example, enhanced demands for increased device functionality and performance may require more system operating power and require additional hardware resources. An increase in power or hardware requirements may also result in a corresponding detrimental economic impact due to increased production costs and operational inefficiencies.

Furthermore, enhanced device capability to perform various advanced display operations may provide additional benefits to a system user, but may also place increased demands on the control and management of various device components. For example, an enhanced electronic device that efficiently manipulates, transfers, and displays digital image data may benefit from an efficient implementation because of the large amount and complexity of the digital data involved.

Due to growing demands on system resources and substantially increasing data magnitudes, it is apparent that developing new techniques for controlling the display of electronic image data is a matter of concern for related electronic technologies. Therefore, for all the foregoing reasons, developing efficient systems for displaying electronic image data remains a significant consideration for designers, manufacturers, and users of contemporary electronic devices.

SUMMARY

In accordance with the present invention, a system and method are disclosed for conserving memory bandwidth during the display period while supporting multiple sprites. In certain embodiments, an electronic device may be implemented to include a central-processing unit (CPU), a display, and a display controller. In one embodiment, the display controller initially receives and stores main display data and sprite data for one or more supported sprites into a video memory or other appropriate storage resource. The display controller may receive the main display data and sprite data from any appropriate source.

The CPU or another appropriate entity may program controller registers coupled to the display controller to indicate certain display characteristics for displaying the supported sprites on the display. In certain embodiments, the display registers may include information regarding sprite locations with respect to a display screen of the display, sprite layer priorities for when the various sprites overlap on the display, and sprite transparency characteristics for presentation of the sprites on the display.

In certain embodiments, the display controller waits for the start of a vertical interval (vertical non-display period) on the display. After the vertical interval has begun, controller logic of the display controller or another appropriate entity populates a fetch table with pixel source identifiers that indicate respective pixel sources (from the supported sprites and the main display data) for providing corresponding display pixels to the display.

In certain embodiments, the controller logic may examine the controller registers to evaluate each display pixel location in a given display frame. More specifically, the controller logic evaluates sprite locations, sprite transparencies, and sprite layer priorities to determine, for each display pixel, which currently active pixel has both the highest sprite layer priority and is non-transparent. The controller logic may then populate the fetch table with appropriate pixel source identifiers according to a pre-determined identifier mapping scheme.

In addition, the controller logic or other appropriate entity monitors the controller registers to determine whether any changes have been made to the sprite locations, sprite layer priorities, sprite transparencies, or any other relevant display characteristics used by the display controller. If the monitored information in the controller registers changes, then the controller logic may recalculate the affected pixel source identifiers in the fetch table.

In certain embodiments, at the beginning of a current display frame for presentation upon the display, the display controller initializes a fetch table pointer of the fetch table to indicate a current pixel source identifier that corresponds to a first display pixel for presentation upon the display. When a current display clock cycle begins, a display pipe of the display controller reads the current pixel source identifier indicated by the fetch table pointer of the fetch table.

The display pipe then accesses the appropriate corresponding display pixel from the pixel source that is indicated by the current pixel source identifier in the fetch table. The display pipe sends the accessed display pixel to the display for presentation. Next, the display controller determines whether more display pixels remain in the current display frame. If more display pixels remain in the current display frame, then the display controller increments the fetch table pointer to indicate the next pixel source identifier as the current pixel source identifier.

The display pipe may then return to similarly access and send the remaining display pixels to the display. However, if no additional pixels remain in the current display frame, then the display controller may return to re-initialize the fetch table pointer for providing a new frame of display pixels to the display in a similar manner. For at least the foregoing reasons, the present invention therefore provides an improved system and method for conserving memory bandwidth while supporting multiple sprites.

DETAILED DESCRIPTION

The present invention relates to an improvement in display controller systems. The following description is presented to enable one of ordinary skill in the art to make and use the invention, and is provided in the context of a patent application and its requirements. Various modifications to the embodiments disclosed herein will be apparent to those skilled in the art, and the generic principles herein may be applied to other embodiments. Thus, the present invention is not intended to be limited to the embodiments shown, but is to be accorded the widest scope consistent with the principles and features described herein.

The present invention comprises a system and method for conserving memory bandwidth during a display period while supporting multiple sprites, and includes a memory device that stores main display data and the multiple sprites for presentation upon a display device. A display controller populates a fetch table with pixel source identifiers that indicate pixel sources from either the main display data or one of the multiple sprites. The pixel source identifiers correspond to display pixels of the display device. The display controller then utilizes the pixel source identifiers to directly locate the appropriate display pixels from the various pixel sources for providing to the display device.

Figure 1:
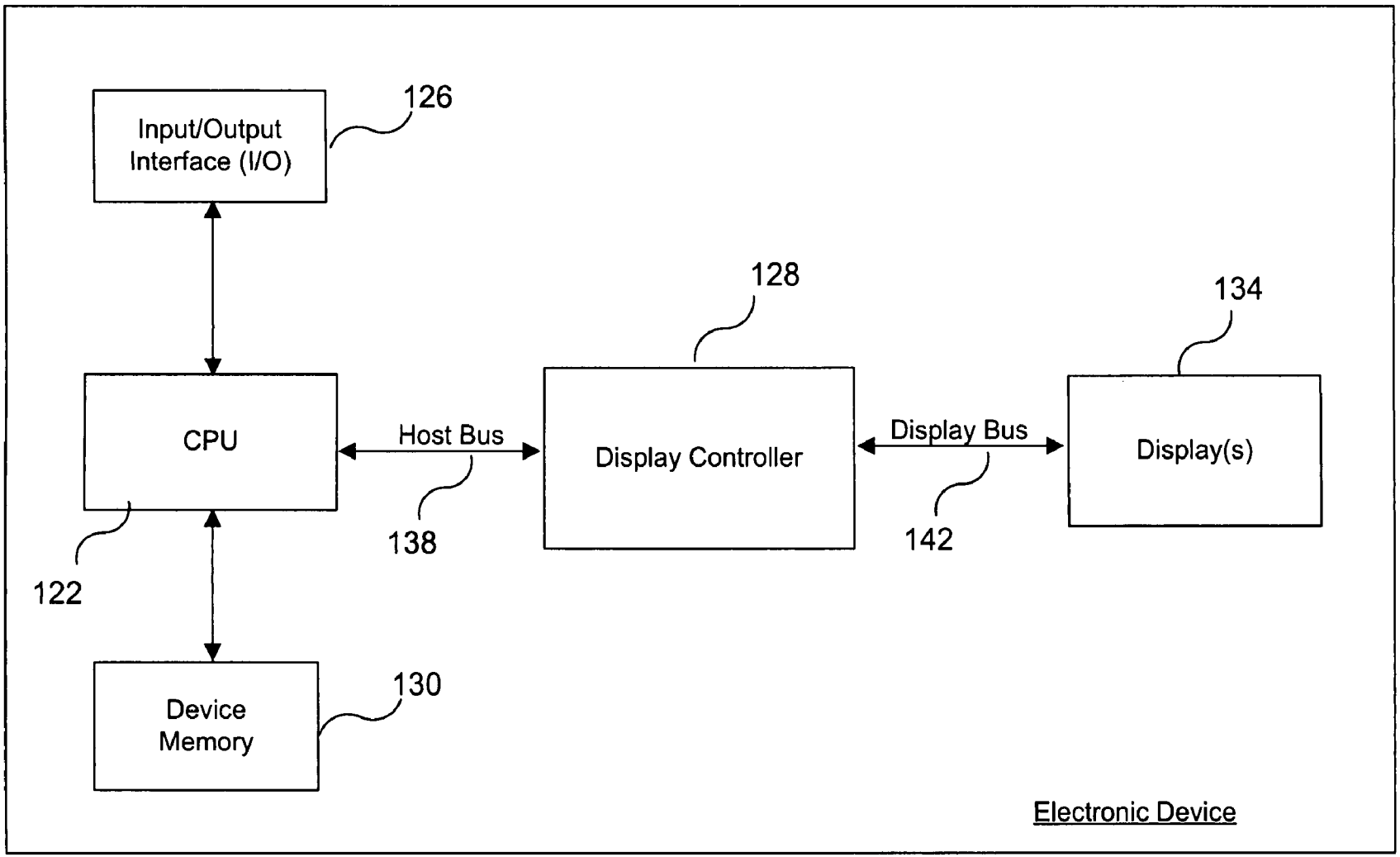
FIG. 1 is a block diagram for one embodiment of an electronic device, in accordance with the present invention.

Referring now to FIG. 1, a block diagram for one embodiment of an electronic device 110 is shown, according to the present invention. The FIG. 1 embodiment includes, but is not limited to, a central processing unit (CPU) 122, an input/output interface (I/O) 126, a display controller 128, a device memory 130, and one or more display(s) 134. In alternate embodiments, electronic device 110 may include elements or functionalities in addition to, or instead of, certain of the elements or functionalities discussed in conjunction with the FIG. 1 embodiment.

In the FIG. 1 embodiment, CPU 122 may be implemented as any appropriate and effective processor device or microprocessor to thereby control and coordinate the operation of electronic device 110 in response to various software program instructions. In the FIG. 1 embodiment, device memory 130 may comprise any desired storage-device configurations, including, but not limited to, random access memory (RAM), read-only memory (ROM), and storage devices such as removable memory or hard disk drives. In the FIG. 1 embodiment, device memory 130 may include, but is not limited to, a device application of program instructions that are executed by CPU 122 to perform various functions and operations for electronic device 110. The particular nature and functionality of the device application typically varies depending upon factors such as the type and specific use of the corresponding electronic device 110.

In the FIG. 1 embodiment, the foregoing device application may include program instructions for allowing CPU 122 to provide image data and corresponding transfer and display information via host bus 138 to display controller 128. In accordance with the present invention, display controller 128 then responsively provides the received image data via display bus 142 to at least one of the display(s) 134 of electronic device 110. In the FIG. 1 embodiment, input/output interface (I/O) 126 may include one or more interfaces to receive and/or transmit any required types of information to or from electronic device 110. Input/output interface 126 may include one or more means for allowing a device user to communicate with electronic device 110. In addition, various external electronic devices may communicate with electronic device 110 through I/O 126. For example, a digital imaging device, such as a digital camera, may utilize input/output interface 126 to provide captured image data to electronic device 110.

In the FIG. 1 embodiment, electronic device 110 may advantageously utilize display controller 128 for efficiently managing various operations and functionalities relating to display(s) 134. The implementation and functionality of display controller 128 is further discussed below in conjunction with FIGS. 2-4 and 6-8. In the FIG. 1 embodiment, electronic device 110 may be implemented as any desired type of electronic device or system. For example, in certain embodiments, electronic device 110 may alternately be implemented as a cellular telephone, a personal digital assistant device, an electronic imaging device, or a computer device. Various embodiments for the operation and utilization of electronic device 110 are further discussed below in conjunction with FIGS. 2-8.

Figure 2:
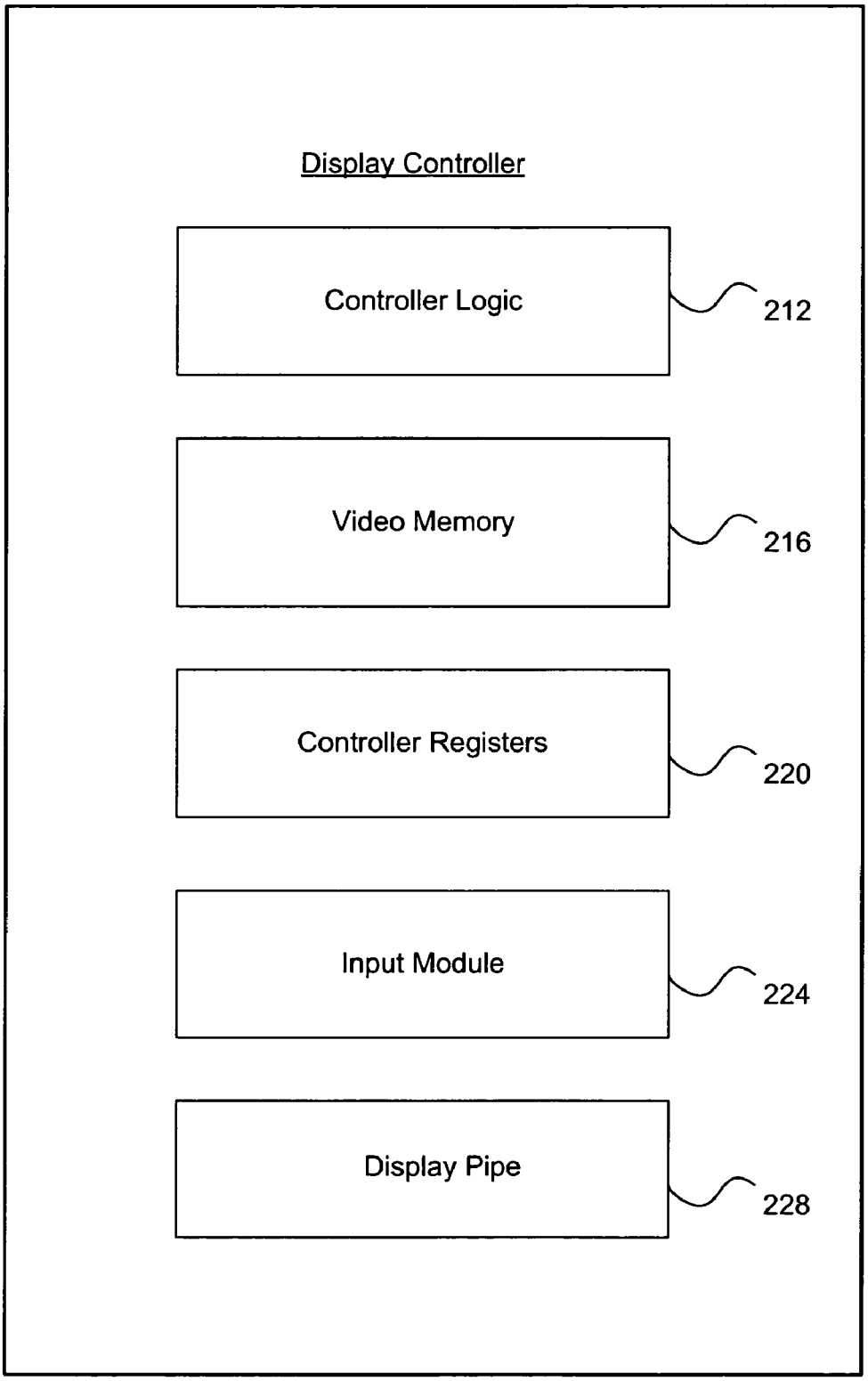
FIG. 2 is a block diagram for one embodiment of the display controller of FIG. 1, in accordance with the present invention.

Referring now to FIG. 2, a block diagram for one embodiment of the FIG. 1 display controller 128 is shown, in accordance with the present invention. The FIG. 2 embodiment includes, but is not limited to, controller logic 212, video memory 216, controller registers 220, an input module 224, and a display pipe 228. In alternate embodiments, display controller 128 may include elements or functionalities in addition to, or instead of, certain of the elements or functionalities discussed in conjunction with the FIG. 2 embodiment.

In the FIG. 2 embodiment, display controller 128 may be implemented as an integrated circuit device that accepts image data and corresponding transfer and display information from CPU 122 (FIG. 1). Display controller 128 then automatically provides the received image data to display 134 of electronic device 110 in an appropriate and efficient manner for displaying to a device user. In the FIG. 2 embodiment, controller logic 212 manages and coordinates the overall operation of display controller 128.

In the FIG. 2 embodiment, display controller 128 may utilize controller registers 220 to store various types of configuration, control and status information. In the FIG. 2 embodiment, display controller 128 may utilize input module 224 to write various types of information and input data into video memory 216 during corresponding write operations. Similarly, display controller 128 may utilize display pipe 228 to read various types of information and main output data and/or sprite data from video memory 216 during corresponding read operations for presentation upon display 134 (FIG. 1). The utilization of display controller is further discussed below in conjunction with FIGS. 3-8.

Figure 3:
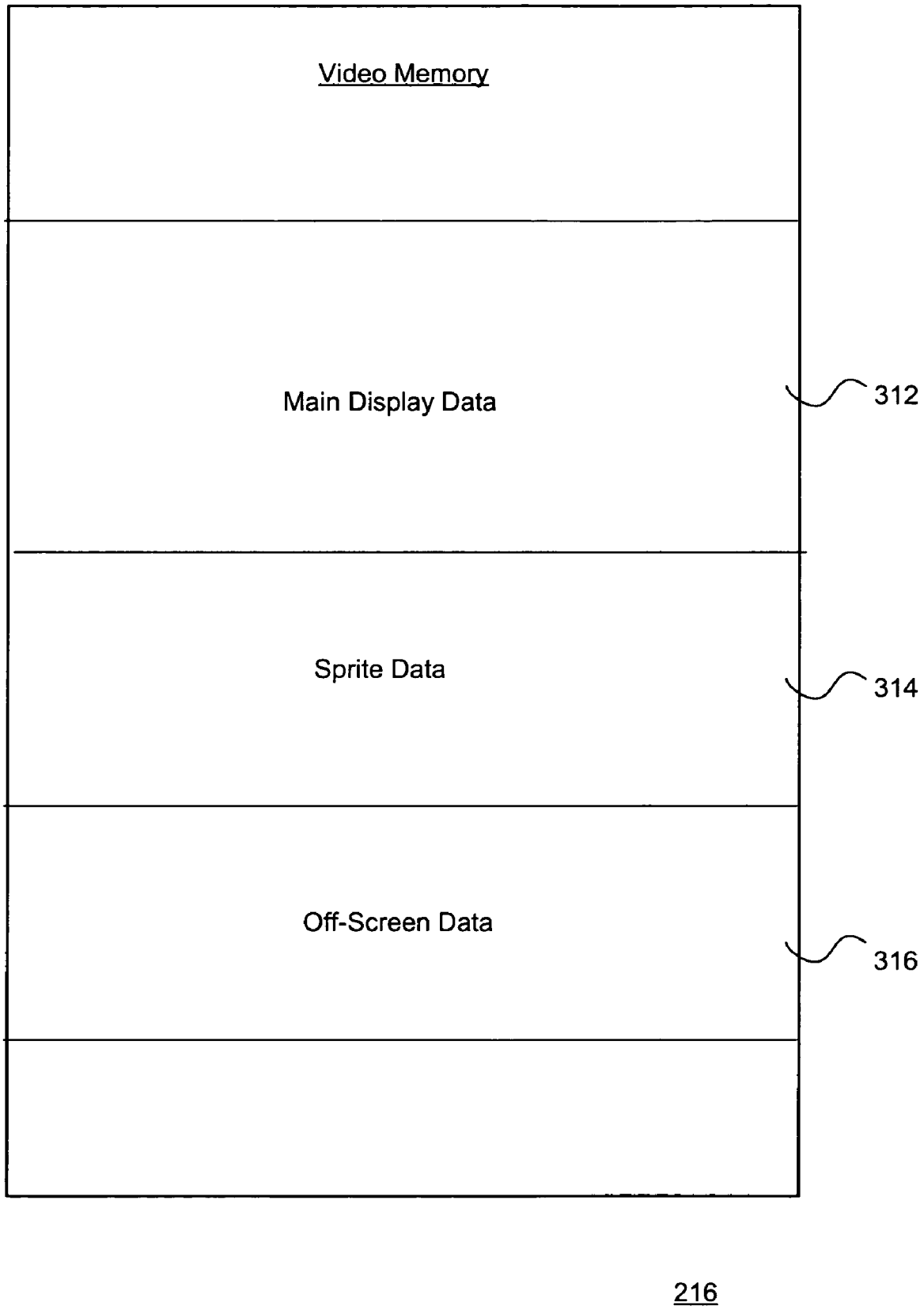
FIG. 3 is a block diagram for one embodiment of the video memory of FIG. 2, in accordance with the present invention.

Referring now to FIG. 3, a block diagram for one embodiment of the FIG. 2 video memory 216 is shown, in accordance with the present invention. In the FIG. 3 embodiment, video memory 216 includes, but is not limited to, main display data 312, sprite data 314, and off-screen data 316. In alternate embodiments, video memory 216 may include elements and functionalities in addition to, or instead of, certain of the elements and functionalities discussed in conjunction with the FIG. 3 embodiment.

In the FIG. 3 embodiment, video memory 216 may be implemented by utilizing any effective types of memory devices or configurations. For example, in certain embodiments, video memory 216 may be implemented as a random-access memory (RAM) device. In the FIG. 3 embodiment, input module 224 or another appropriate entity writes main display data 312 into video memory 216 for subsequent transfer by to a main window area on a screen of display 134 of electronic device 110 for viewing by a device user. In the FIG. 3 embodiment, sprite data 314 may include any desired type of image data for presentation on display 134 in conjunction with main display data 312. For example, sprite data 314 may include image data representing a display cursor, a gaming object, a display icon, or any desired visual element for display in conjunction with main display data 312. In accordance with the present invention, sprite data 314 may include data for an desired number of individual sprites.

In the FIG. 3 embodiment, off-screen data 316 may include any appropriate type of information or data that is not intended for presentation upon display 134 of electronic device 110. For example, off-screen data 316 may be utilized to cache certain fonts or other objects for use by display controller 128. The display of sprite data 314 is further discussed below in conjunction with FIGS. 6-8.

Figure 4:
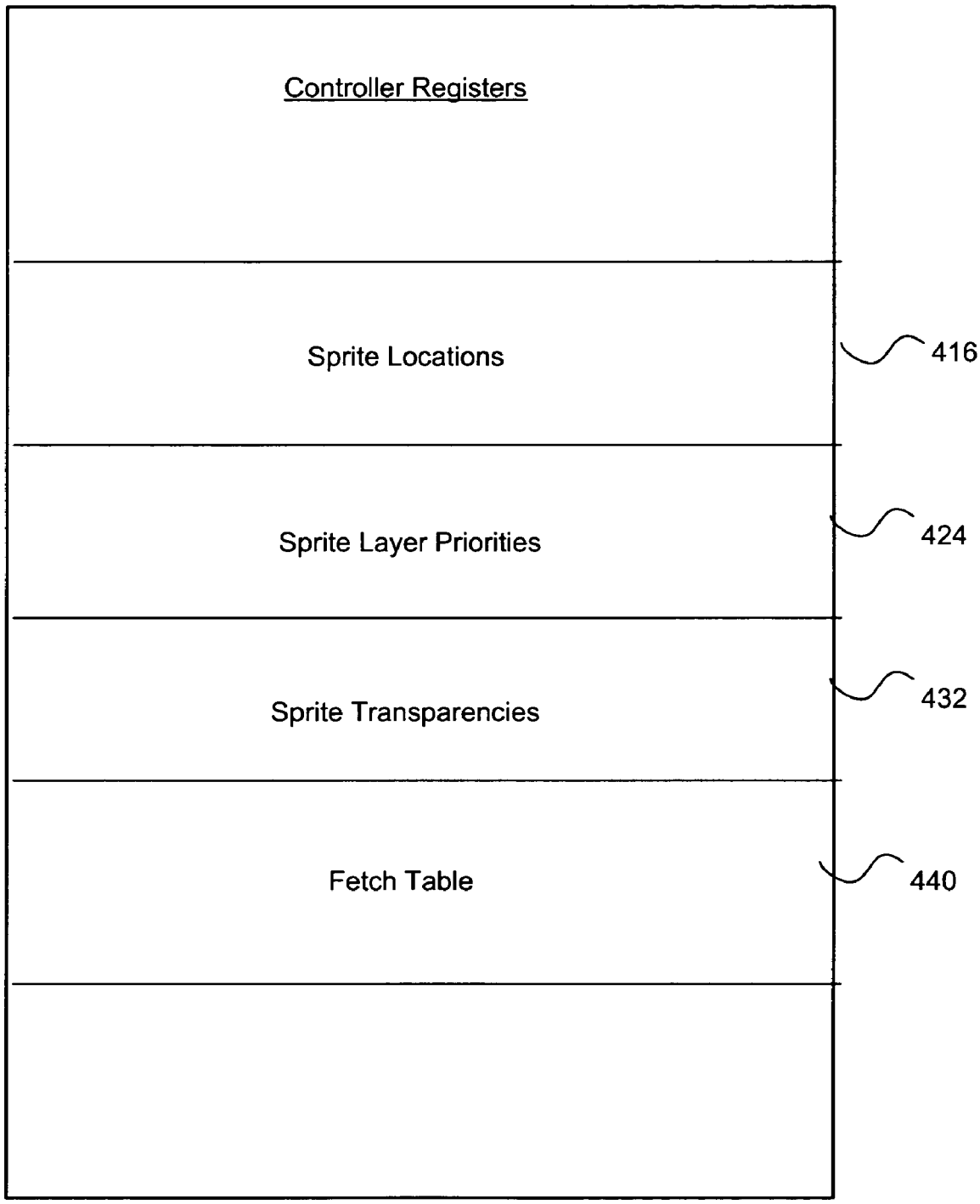
FIG. 4 is a block diagram for one embodiment of the controller registers of FIG. 2, in accordance with the present invention.

Referring now to FIG. 4, a block diagram for one embodiment of the FIG. 2 controller registers 220 is shown, in accordance with the present invention. In the FIG. 4 embodiment, controller registers 220 include, but are not limited to, sprite locations 416, sprite layer priorities 424, sprite transparencies 432, and a fetch table 440. In alternate embodiments, controller registers 220 may include elements and functionalities in addition to, or instead of, certain of the elements and functionalities discussed in conjunction with the FIG. 4 embodiment.

In the FIG. 4 embodiment, sprite locations 416 include location information for displaying any desired number of sprites from sprite data 314 (FIG. 3) on display 134 (FIG. 1). For example, sprite locations 416 may include specific corner pixel coordinates of the supported sprites. In the FIG. 4 embodiment, sprite layer priorities 424 include a layer priority value for each sprite that is supported for display by display controller 128 (FIG. 2). In the event that multiple sprites are requested to be displayed upon a given area of display 134 in an overlapping manner, the sprite with the highest priority value is the sprite that is actually displayed on that given area of display 134. In the FIG. 4 embodiment, sprite transparencies 432 include a transparency value for each sprite that is supported for display by display controller 128 (FIG. 2). For example, in certain embodiments, the transparency values may indicate that corresponding sprites are either transparent or non-transparent when displayed upon display 134.

In the FIG. 4 embodiment, display controller 128 or other appropriate entity may create and utilize fetch table 440 to support multiple sprites on display 134, in accordance with the present invention. In the FIG. 4 embodiment, fetch table 440 may include pixel source identifiers that indicate a pixel source (from one of the supported sprites or the main display data) for each pixel displayed on display 134. In certain alternate embodiments, fetch table 440 may be stored in any other appropriate location. The creation and utilization of fetch table 440 is further discussed below in conjunction with FIGS. 6-8.

Figure 5:
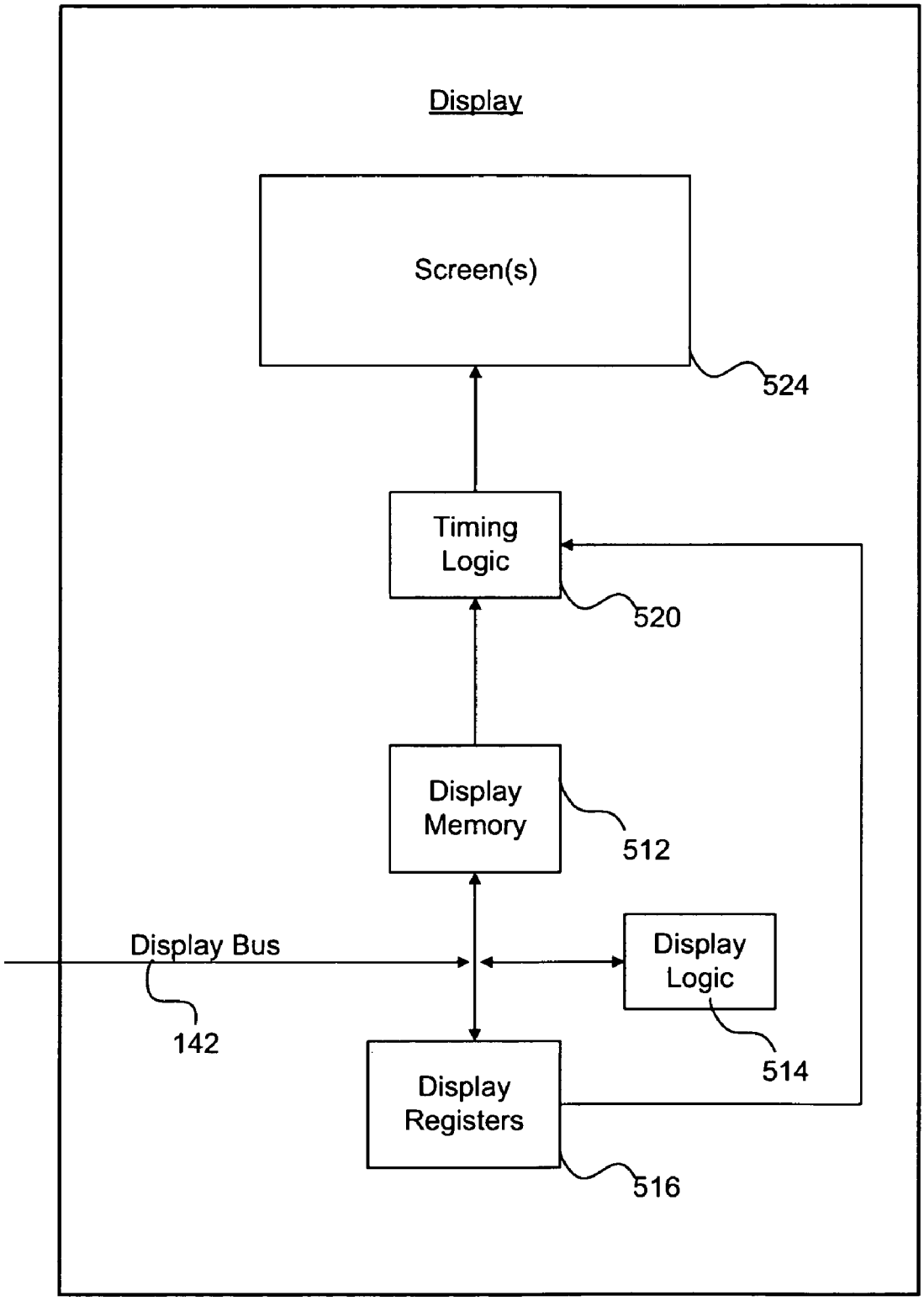
FIG. 5 is a block diagram for one embodiment of the display of FIG. 1, in accordance with the present invention.

Referring now to FIG. 5, a block diagram for one embodiment of the FIG. 1 display 134 is shown, in accordance with the present invention. In the FIG. 5 embodiment, display 134 includes, but is not limited to, a display memory 512, display logic 514, display registers 516, timing logic 520, and one or more screen(s) 524. In alternate embodiments, display 134 may include elements and functionalities in addition to, or instead of, certain of the elements and functionalities discussed in conjunction with the FIG. 5 embodiment.

In the FIG. 5 embodiment, display 134 is implemented as a random-access-memory based liquid-crystal display panel (RAM-based LCD panel). However, in alternate embodiments, display 134 may be implemented by utilizing any type of appropriate display technologies or configurations. In the FIG. 5 embodiment, display controller 128 provides various types of display information to display registers 516 via display bus 142. Display registers 516 may then utilize the received display information for effectively controlling timing logic 520. In the FIG. 5 embodiment, display logic 514 manages and coordinates data transfer and display functions for display 134.

In the FIG. 5 embodiment, display controller 128 provides image data from display buffer 312 (FIG. 3) to display memory 512 via display bus 142. In the FIG. 5 embodiment, display memory 512 is typically implemented as random-access memory (RAM). However, in various other embodiments, any effective types or configurations of memory devices may be utilized to implement display memory 512. In the FIG. 5 embodiment, display memory 512 then advantageously provides the image data received from display controller 128 to one or more screens 524 via timing logic 520 for viewing by a device user of electronic device 110.

Figures 6A, 6B:
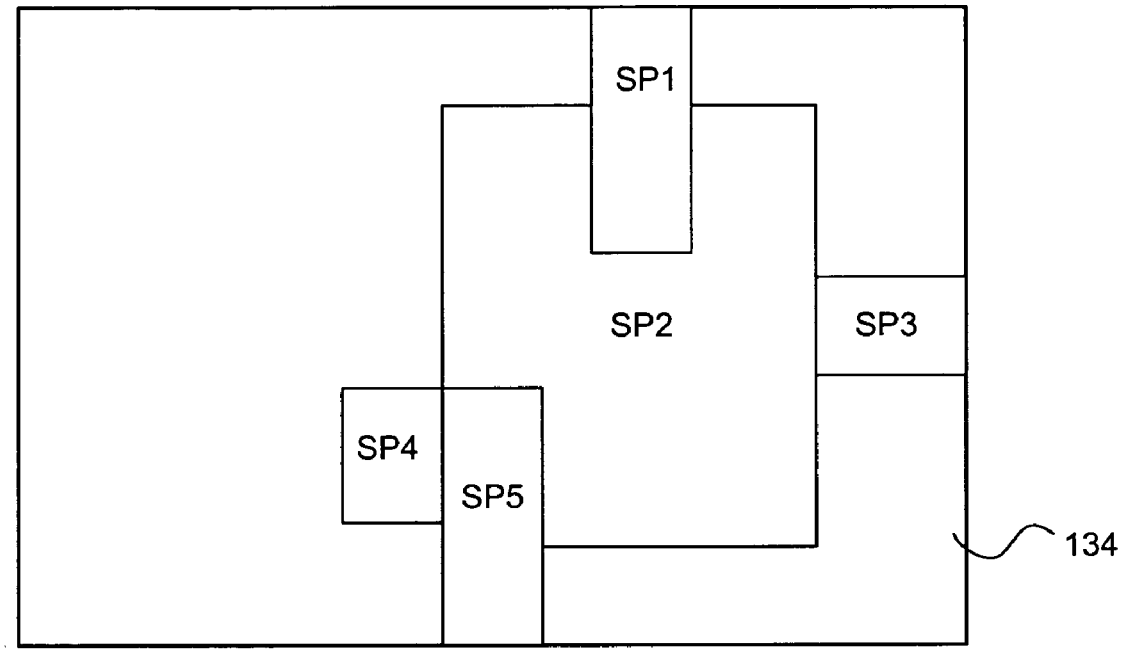
FIGS. 6A and 6B are drawings illustrating one embodiment of a fetch table and corresponding display, in accordance with the present invention.

Referring now to FIGS. 6A and 6B, drawings illustrating one embodiment of a fetch table 440 and corresponding display 134 are shown, in accordance with the present invention. The example shown in FIGS. 6A and 6B is presented for purposes of illustration, and in alternate embodiments, the present invention may efficiently support multiple sprites by utilizing configurations and techniques in addition to, or instead of, certain of those configurations and techniques shown in the embodiment of FIG. 6

In certain embodiments of the present invention, display controller 128 (FIG. 1) or another appropriate entity may create a fetch table 440 to identify currently-active display pixels from specific pixel sources (one of the supported sprites from sprite data 314 or the main display data 312) for being provided by display controller 128 to display 134 (FIG. 1). Therefore, in certain embodiments, fetch table 440 includes separate pixel source identifiers for each pixel in current display frames of image data. For example, a display 134 that has 320 pixels by 240 pixels may be implemented to include a total of 76,800 individual pixel source identifiers.

If ten separate sprites are supported by display controller 128, then one possible mapping configuration for the pixel source identifiers in fetch table 440 may be as shown below in TABLE I:

TABLE I

| Pixel Source Identifier | Pixel Source |
|---|---|
| 0 | Main Image |
| 1 | Sprite 1 |
| 2 | Sprite 2 |
| 3 | Sprite 3 |
| 4 | Sprite 4 |
| 5 | Sprite 5 |
| 6 | Sprite 6 |
| 7 | Sprite 7 |
| 8 | Sprite 8 |
| 9 | Sprite 9 |
| 10 | Sprite 10 |

Using the foregoing mapping configuration of TABLE I, if a given display pixel has a pixel source identifier in fetch table 440 that is equal to 5, then display controller 128 may immediately access and provide the corresponding display pixel from sprite 5 in sprite data 314 (FIG. 3) for presentation on display 134. In many instances, some of the supported sprites may be transparent, as indicated in sprite transparencies 432 (FIG. 4). In addition, the supported sprites typically are ranked for display upon display 134 according to sprite layer priorities 424 (FIG. 4).

By utilizing fetch table 440, display controller 128 may advantageously go directly to access an appropriate display pixel from the currently active sprite or main display data 312, instead of searching individually through each of the sprites to determine which sprite has both the highest sprite layer priority value and is non-transparent. Utilizing fetch table 440 therefore advantageously allows display controller 128 to conserve significant memory bandwidth, run at a lower display clock, and conserve operating power.

In accordance with certain embodiments, controller logic 212 of display controller 128 calculates the pixel source identifiers to populate fetch table 440 during a vertical non-display period (VNDP) of display 134. Controller logic 212 may examine controller registers 220 (FIG. 2) to evaluate each display pixel location in a given display frame. More specifically, controller logic 212 evaluates sprite locations 416, sprite transparencies 432, and sprite layer priorities 424 (FIG. 4) to determine, for each display pixel, which pixel source has both the highest sprite layer priority 424 and is non-transparent. If no sprite is non-transparent at the currently display pixel location, then controller logic 212 may indicate main display data 312 as the current pixel source. Controller logic 212 may thus populate fetch table 440 with an appropriate pixel source identifier according to the foregoing TABLE I configuration or any other appropriate identifier mapping scheme.

In the FIG. 6A example, display 134 is shown with five exemplary sprites that are displayed over main display data 312 (FIG. 3). The five sprites of FIG. 6A are indicated as SP1, SP2, SP3, SP4, and SP5. In the FIG. 6B example, a fetch table 440 is shown with pixel source identifiers corresponding to the sprite locations shown in FIG. 6A. For purposes of clarity, the FIG. 6B fetch table 440 is shown with a greatly reduced number of pixel source identifiers.

In addition, for purposes of illustration, the FIG. B fetch table 440 is shown in a format that correlates physical locations of the pixel source identifiers of fetch table 440 to corresponding physical locations of the sprites on the display 134 of FIG. 6A. However, in alternate embodiments, fetch table 440 may be implemented in other configurations in which physical locations of pixel source identifiers in fetch table 440 do not physically correlate to corresponding physical locations of the sprites on the display 134.

The FIG. 6B fetch table 440 utilizes pixel source identifiers that conform to the identifier mapping conventions shown above in conjunction with TABLE I. Therefore, pixel source identifiers that are equal to zero (0) indicate no active sprite at that pixel location, and display controller 128 may provide display pixels from main display data 312 (FIG. 3) to display 134. Pixel source identifiers that are equal to one (1) indicate that sprite 1 (SP1) is active at that display pixel location, and display controller 128 may then provide display pixels from sprite 1 in sprite data 314 (FIG. 3) to display 134.

Similarly, pixel source identifiers that are equal to two (2) indicate that sprite 2 (SP2) is active at that display pixel location, and display controller 128 may provide display pixels from sprite 2 in sprite data 314 to display 134. In addition, the pixel source identifier that is equal to three (3) indicates that sprite 3 (SP3) is active at that display pixel location, and display controller 128 may provide display pixels from sprite 3 in sprite data 314 to display 134. Furthermore, the pixel source identifier that is equal to four (4) indicates that sprite 4 (SP4) is active at that display pixel location, and display controller 128 may provide display pixels from sprite 4 in sprite data 314 to display 134. Finally, pixel source identifiers that are equal to five (5) indicate that sprite 5 (SP5) is active at that display pixel location, and display controller 128 may provide display pixels from sprite 5 in sprite data 314 to display 134. The creation and utilization of fetch table 440 is further discussed below in conjunction with FIGS. 7 and 8.

Figure 7:
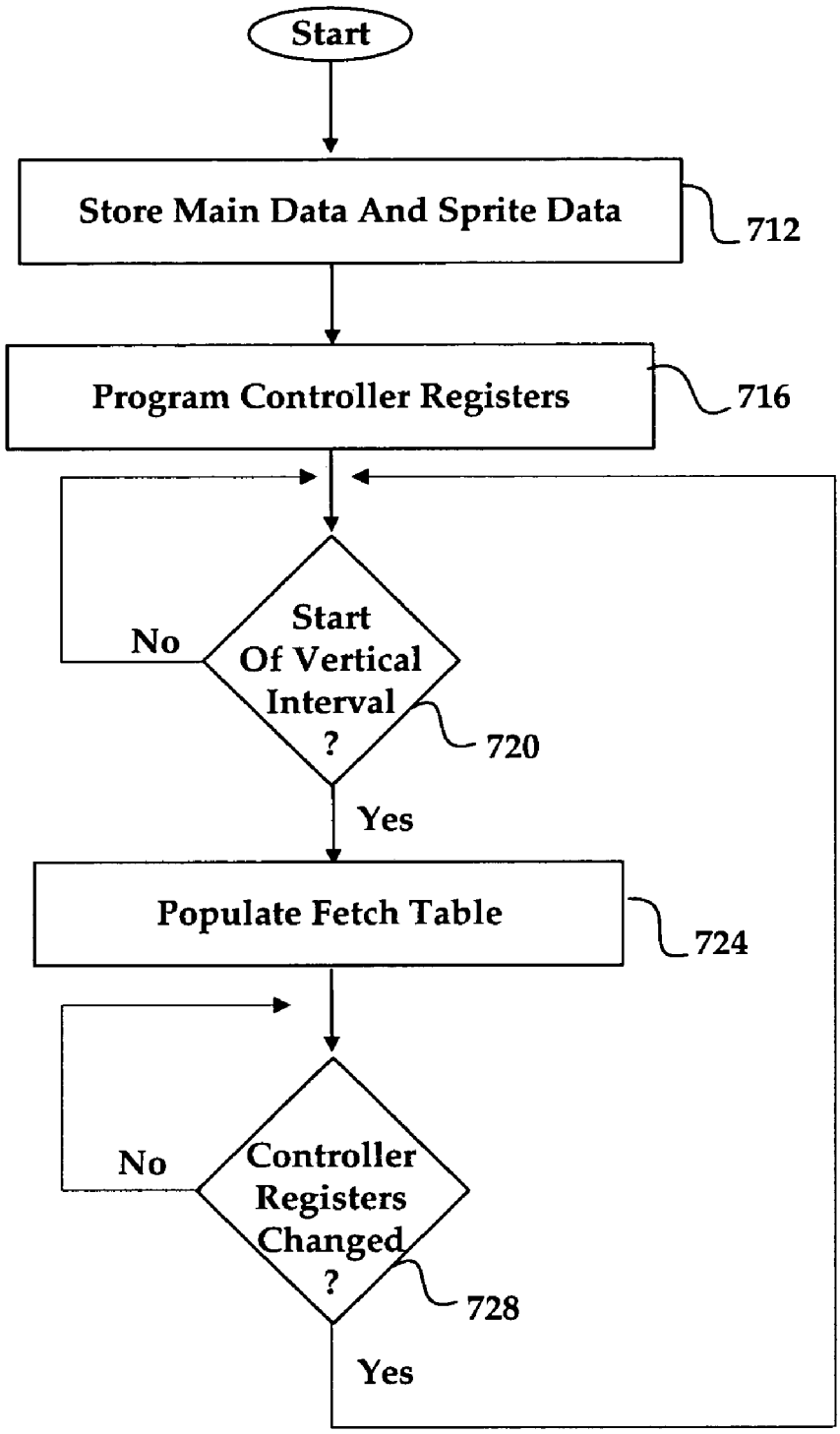
FIG. 7 is a flowchart of method steps for populating a fetch table, in accordance with one embodiment of the present invention.

Referring now to FIG. 7, a flowchart of method steps for populating a fetch table 440 is shown, in accordance with one embodiment of the present invention. The flowchart of FIG. 7 is presented for purposes of illustration, and in alternate embodiments, the present invention may utilize steps and sequences in addition to, or instead of, certain of the steps and sequences discussed in conjunction with the embodiment shown in FIG. 7.

In the FIG. 7 embodiment, in step 712, a display controller 128 (FIG. 1) receives and stores main display data 312 and sprite data 314 for one or more supported sprites into a video memory 216 or other appropriate storage resource. Display controller 128 may receive the main display data 312 and sprite data 314 from any appropriate source, such as CPU 122 (FIG. 1). In step 716, CPU 122 or another appropriate entity may program controller registers 220 coupled to display controller 128 to indicate certain display characteristics for displaying the supported sprites on display 134. In the FIG. 7 embodiment, display registers 220 may include information regarding sprite locations 416 with respect to a display screen of display 134, sprite layer priorities 424 for presentation of overlapping sprites on display 134, and sprite transparencies 432 for presentation of the sprites on display 134.

In step 720, display controller 128 waits for the start of a vertical interval (vertical non-display period) on display 134. In step 724, after the vertical interval has begun, controller logic 212 of display controller 128 or another appropriate entity populates a fetch table 440 (FIG. 6B) with pixel source identifiers that indicate respective pixel sources (from the supported sprites and the main display data) for corresponding display pixels of display 134.

In certain embodiments, controller logic 212 may examine controller registers 220 (FIG. 2) to evaluate each display pixel location in a given display frame. More specifically, controller logic 212 may evaluate sprite locations 416, sprite transparencies 432, and sprite layer priorities 424 (FIG. 4) to determine, for each display pixel, which currently active pixel has both the highest sprite layer priority 424 and is non-transparent. Controller logic 212 may then populate fetch table 440 with an appropriate pixel source identifier according to a pre-determined identifier mapping scheme.

In step 728, controller logic 212 or other appropriate entity monitors controller registers 220 to determine whether any changes have been made to the sprite locations 416, sprite layer priorities 424, sprite transparencies 432, or any other relevant display characteristics used by display controller 128. In step 728, if the monitored information in controller registers 220 has changed, then the FIG. 7 process may return to step 720 to recalculate the affected pixel source identifiers in fetch table 440. One embodiment for utilizing the foregoing fetch table 440 is discussed below in conjunction with FIG. 8.

Figure 8:
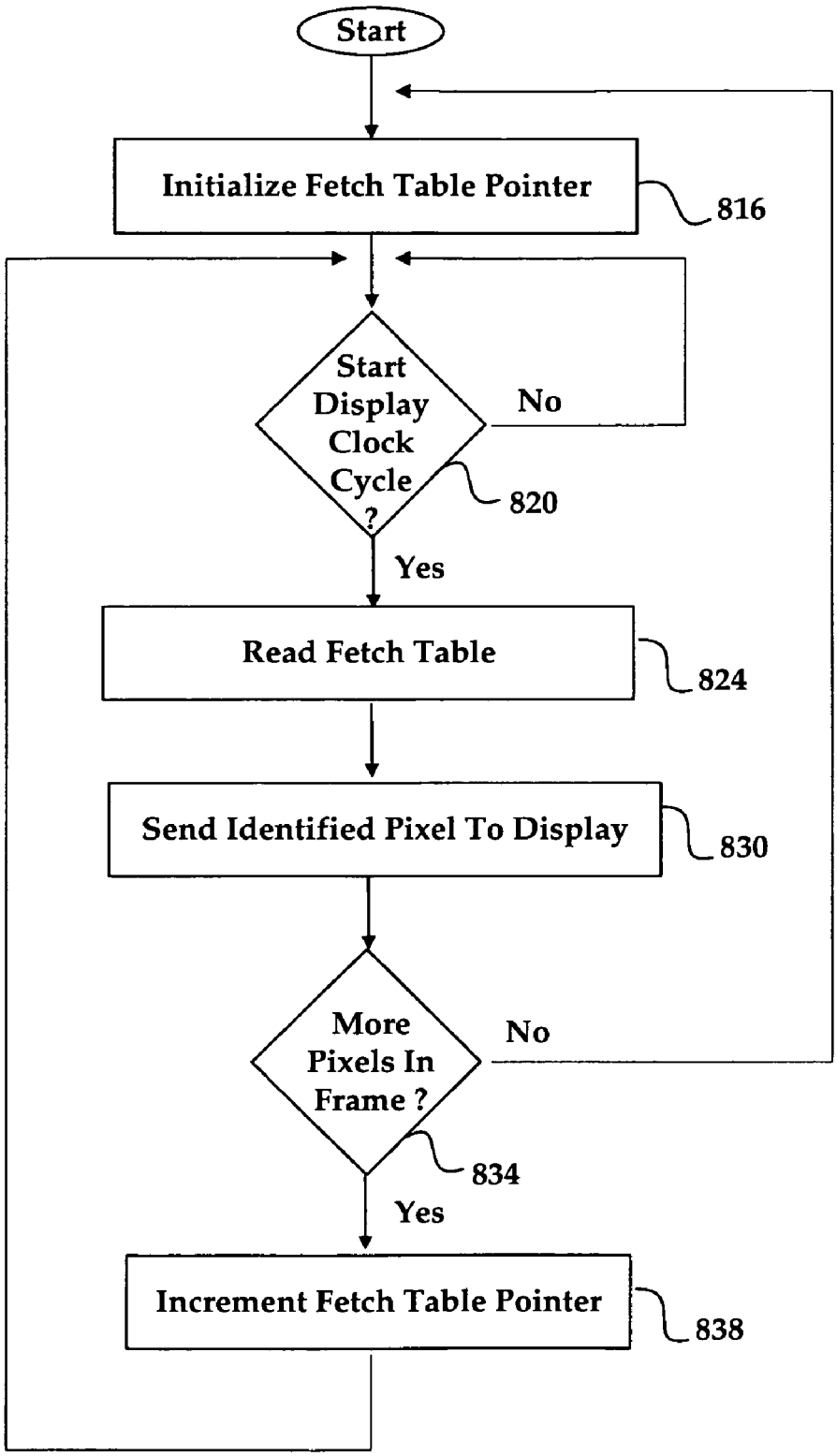
FIG. 8 is a flowchart of method steps for utilizing a fetch table, in accordance with one embodiment of the present invention.

Referring now to FIG. 8, a flowchart of method steps for utilizing a fetch table 440 is shown, in accordance with one embodiment of the present invention. The flowchart of FIG. 8 is presented for purposes of illustration, and in alternate embodiments, the present invention may utilize steps and sequences in addition to, or instead of, certain of the steps and sequences discussed in conjunction with the embodiment shown in FIG. 8.

In step 816 of the FIG. 8 embodiment, at the beginning of a current display frame for presentation upon a display 134, display controller 128 (FIG. 1) initializes a fetch table pointer of a fetch table 440 (FIG. 6B) to indicate a current pixel source identifier that corresponds to a first display pixel for presentation upon display 134. In step 820, a current display clock cycle begins, and then in step 824, a display pipe 228 (FIG. 2) of display controller 128 reads the current pixel source identifier indicated by the fetch table pointer of fetch table 440.

In step 830, display pipe 228 then accesses the appropriate corresponding display pixel from the pixel source that is indicated by the current pixel source identifier in fetch table 440. Display pipe 228 sends the accessed display pixel to display 134 for presentation. In step 834, display controller 128 determines whether more display pixels remain in the current display frame. If more display pixels remain in the current display frame, then display controller 128 increments the fetch table pointer to indicate the next pixel source identifier as the current pixel source identifier.

The FIG. 8 process may then return to step 820 to similarly access and send the remaining display pixels to display 134. However, in step 834, if no additional pixels remain in the current display frame, then the FIG. 8 process may return to step 816 to re-initialize the fetch table pointer for providing a new frame of display pixels to display 134 in a similar manner. For at least the foregoing reasons, the present invention therefore provides an improved system and method for conserving memory bandwidth while supporting multiple sprites.

The invention has been explained above with reference to certain preferred embodiments. Other embodiments will be apparent to those skilled in the art in light of this disclosure. For example, the present invention may be implemented using certain configurations and techniques other than those described in the embodiments above. Additionally, the present invention may effectively be used in conjunction with systems other than those described above as the preferred embodiments. Therefore, these and other variations upon the foregoing embodiments are intended to be covered by the present invention, which is limited only by the appended claims.

What is claimed is:

1. A display controller for efficiently supporting sprites in an electronic device that has a memory device that stores main display data and said sprites for presentation upon a display device, the display controller populating a fetch table with pixel source identifiers that indicate pixel sources from among said main display data and said sprites, said pixel source identifiers corresponding to display pixels that are actively displayed on said display device, said display controller utilizing said pixel source identifiers to directly locate said display pixels from said pixel sources, said display controller providing said display pixels from said memory device directly to said display device; and initializing a fetch table pointer for a current pixel source identifier to begin a new display frame of display pixels on said display device, said current pixel source identifier corresponding to a current display pixel for immediate display on said display device;

wherein display pipe of said display controller reads said current pixel source identifier, said display pipe then fetching said current display pixel from said memory device and providing said current display pixel directly to said display device without any intervening processing or temporary storage; and said display pipe reads said new current pixel source identifiers and fetches said new current display pixels at a fetch rate of one display pixel per clock cycle of a display clock; and wherein said fetch rate conserves memory bandwidth for accessing said memory device, said fetch rate also conserving operating power for said electronic device because of optimizing said fetch rate, said fetch rate being achieved by said display pipe of said display controller through direct display-pixel identifications from said fetch table.

2. The display controller of claim 1 wherein said display controller is implemented as an integrated circuit device that functions as an interface between a central processing unit and said display device in a portable electronic device.

3. The display controller of claim 1 wherein a central processing unit of said electronic device stores said main display data and said sprites into said memory device for said display controller to provide to said display device.

4. The display controller of claim 1 wherein a central processing unit of said electronic device programs controller registers of said display controller with display characteristics for presenting said sprites upon said display device.

5. The display controller of claim 4 wherein said display characteristics include sprite locations that define specific display locations on said display device for each of said sprites.

6. The display controller of claim 4 wherein said display characteristics include sprite layer properties that define display priorities for each of said sprites in relation to the remaining ones of said sprites when said sprites overlap on said display device.

7. The display controller of claim 4 wherein said display characteristics include sprite transparencies that define a transparency characteristic for each of said sprites.

8. The display controller of claim 1 wherein controller logic of said display controller calculates each of said pixel source identifiers by initially examining sprite locations for each of said sprites to determine whether one or more of said sprites is active at a current display pixel location.

9. The display controller of claim 8 wherein said controller logic analyzes sprite layer priorities and sprite transparencies to identify a current pixel source for said current display pixel location that is displayed on said display device, said current pixel source being one of said sprites that simultaneously has both a highest sprite layer priority and is non-transparent, said controller logic identifying said main display data as said current pixel source when none of said sprites are active and non-transparent at said current display pixel location.

10. The display controller of claim 1 wherein said display controller performs pixel-source calculation procedures in advance during a vertical non-display period of said display device in order to populate said fetch table before referencing said fetch table during one or more immediately-succeeding display clock cycles.

11. The display controller of claim 1 wherein controller logic of said display controller calculates separate pixel source identifiers for each of said display pixels of said display device, said separate pixel source identifiers being mapped through said fetch table to respective corresponding ones of said display pixels that are currently active on said display device.

12. The display controller of claim 1 wherein said display controller recalculates at least some of said pixel source identifiers during a subsequent vertical non-display period of said display device whenever any predefined sprite display characteristics stored in programmable controller registers are changed.

13. The display controller of claim 1 wherein said display controller repeatedly increments said fetch table pointer to indicate new current pixel source identifiers corresponding to new current display pixels for said display device.

14. The display controller of claim 13 wherein said display pipe repeatedly reads said new current pixel source identifiers, said display pipe then fetching said new current display pixels and providing said new current display pixels directly to said display device to complete said new display frame.

15. A display controller method for efficiently supporting sprites in an electronic device that has a memory for storing main display data and said sprites for presentation upon a display device, the display controller method comprising:

populating a fetch table with pixel source identifiers that indicate pixel sources from among said main display data and said sprites, said pixel source identifiers corresponding to display pixels that are actively displayed on said display device, said display controller utilizing said pixel source identifiers to directly locate said display pixels from said pixel sources, said display controller providing said display pixels from said memory device directly to said display device;

initializing a fetch table pointer for a current pixel source identifier to begin new display frame of display pixels on said display device, said current pixel source identifier corresponding to a current display pixel for immediate display on said display device;

utilizing a display of said display controller to read said current pixel source identifier, said display pipe then fetching said current display pixel from said memory device and providing said current display pixel directly to said display device without any intervening processing or temporary storage; and said display ripe reads said new current pixel source identifiers and fetches said new current display pixel at a fetch rate of one display pixel per clock cycle of a display clock; and wherein said fetch rate conserves memory bandwidth for accessing said memory device, fetch rate also conserving operating power for said electronic device because of optimizing said fetch rate, said fetch rate being achieved by said display pipe of said display controller through direct display-pixel identifications from said fetch table.

* * * * *

UNITED STATES PATENT AND TRADEMARK OFFICE

CERTIFICATE OF CORRECTION

PATENT NO. : 7,489,320 B2
APPLICATION NO. : 11/128554
DATED : February 10, 2009
INVENTOR(S) : Barinder Singh Rai et al.

It is certified that error appears in the above-identified patent and that said Letters Patent is hereby corrected as shown below:

Column 12,

Line 14, please change "ripe" to --pipe--

Column 12,

Line 19, please insert --said-- after "device,"

Signed and Sealed this

Twenty-sixth Day of May, 2009

John Doll

JOHN DOLL
*Acting Director of the United States Patent and Trademark Office*